US006018977A

United States Patent [19]

Kanno et al.

[11] Patent Number: 6,018,977

[45] Date of Patent: Feb. 1, 2000

[54] METHOD OF FORMING A CYLINDRICAL BOSS AND A DIE THEREFOR

[75] Inventors: Kazunobu Kanno, Toyohashi; Kenji Obata; Yoshihiko Kato, both of Kosai, all of Japan

[73] Assignee: Asmo Co., Ltd., Shizuoka-pref., Japan

[21] Appl. No.: 09/181,696

[22] Filed: Oct. 28, 1998

[30] Foreign Application Priority Data

Nov. 10, 1997 [JP] Japan ..... 9-307282

[51] Int. Cl.[7] ..... B21K 1/40

[52] U.S. Cl. ..... 72/355.4; 29/894.362; 72/358

[58] Field of Search ..... 72/325, 354.6, 72/354.8, 355.4, 358, 370.01; 29/894.362

[56] References Cited

U.S. PATENT DOCUMENTS 2,027,922 1/1936 McNaught ..... 72/325
5,517,844 5/1996 Yuan ..... 72/325

FOREIGN PATENT DOCUMENTS 7-155888 12/1993 Japan .
7-124657 5/1995 Japan .

OTHER PUBLICATIONS

Nakano et al.; "Flow Control Forming in Sheet Metal (FCF Method)"; Die Tehnology, vol. 8, Jul. 1993 pp. 118–119.

*Primary Examiner*—Lowell A. Larson
*Attorney, Agent, or Firm*—Fish & Richardson P.C.

[57] ABSTRACT

A crude work having a cylindrical boss formed integrally with a base plate is processed to a final product by a press work without using additional machining. An inner diameter of the boss is enlarged by a punch, and at the same time an outer diameter of the boss is shrunk by an outer die, while the work is supported on a cushion ring to which a force against the movement of the punch and the outer die is applied. Some of the material constituting the cylindrical boss is squeezed, and a bulge is formed at a foot of the cylindrical boss out of the material squeezed. Since the bulge is fromed in a confined space in the die structure, no crack or defect develops in or on the bulge. The bulge is further compressed by a press work to form a flat flange out of the bulge. The cylindrical boss having the flange formed integrally therewith is used as a center boss for holding a bearing of a rotary machine.

4 Claims, 4 Drawing Sheets

METHOD OF FORMING A CYLINDRICAL BOSS AND A DIE THEREFOR

CROSS-REFERENCE TO RELATED APPLICATION

This application is based upon and claims benefit of priority of Japanese Patent Applications No. Hei-9-307282 filed on Nov. 10, 1997, the content of which is incorporated herein by reference.

BACKGROUND OF THE INVENTION

1. Field of the Invention

The present invention relates to a method of forming a cylindrical boss on a base plate and a die for forming the boss, and more particularly to a method of forming a center boss having a flange for holding a bearing therein and a die for forming such a center boss.

2. Description of Related Art

As a method of manufacturing a cylindrical boss having a small step therein from a steel plate, a method of controlling a thickness and a shape of a metal plate (FCF method) is generally known. The CFC method utilizes various processes such as fixing in cold-forging, ironing, and extruding in addition to conventional processes such as stamping, drawing, bending and fluing.

A method of making a bulge at a foot of a cylindrical boss and a die for use in the method are disclosed in JP-A-7-124657, a part of which is illustrated in FIG. 8 attached hereto for reference purpose. Referring to FIG. 8, the die includes a lower die 35, an upper die 38 and a punch 30. A work having a cylindrical boss 32 is held between the lower die 35 and the upper die 38. The punch 30 is pressed into an inner bore of the cylindrical boss 32 to form a bulge 34 at a base portion 33 of the cylindrical boss 32. The punch 30 is rod-shaped and has a front surface 36 connected to a main rod by a tapered portion 31. A corner having a small radius r is formed at a foot of the cylindrical boss 32 at the same time the bulge 34 is formed by pressing down the punch 30. The bulge 34 is formed along a depressed curve of the punch 30, and the corner with the radius r bulges out into a space 37 between the lower die 35 and the punch 30. At the same time a depression 39 is formed at an outside foot of the cylindrical boss 32. The depression 39 is undesirable because a crack develops at the depression 39 when the bulge 34 is further processed to form a flange. The crack developed at the outer foot of the cylindrical boss 32 is detrimental to a mechanical strength of the cylindrical boss. Because of this, the flange in the cylindrical boss is separately made and assembled into the boss in a conventional process. Accordingly, a production cost for making the cylindrical boss becomes expensive.

SUMMARY OF THE INVENTION

The present invention has been made in view of the above-mentioned problems, and an object of the present invention is to provide a method of forming a cylindrical boss having a high and reliable mechanical strength integrally with a base plate in an inexpensive process. Another object of the present invention is to provide a die for forming such a cylindrical boss.

According to the present invention, a crude cylindrical boss formed on and integrally with a base plate is processed to a final shape of a cylindrical boss which includes a flat flange formed at an inside foot of the cylindrical boss. First, the crude cylindrical boss is processed to form a bulge from which the flange is formed. A punch having a diameter larger than an inner diameter of the crude cylindrical boss is forcibly inserted into the crude cylindrical boss, and at the same time an ironing die having a bore, the diameter of which is smaller than an outer diameter of the crude cylindrical portion, is forcibly slid along the outer diameter of the crude cylindrical boss. The crude cylindrical boss is supported on a cushion ring which is pressed against the force applied by inserting the punch into the crude cylindrical boss and sliding the ironing die along the outside diameter of the crude cylindrical boss. Some of the material constituting the crude cylindrical boss is squeezed by the punch and the ironing die and swells into a confined space in the die structure. The bulge is formed at the inside foot of the cylindrical boss out of the material swelled into the confined space. At the same time, the inner and outer diameters of the crude cylindrical boss are shaped into final dimensions, so that the finished cylindrical boss is used as a center boss for holding a bearing therein without performing additional machining.

Then, the bulge is deformed into a flat flange extending inwardly from the inside foot of the cylindrical boss in the next process. The work having the bulge is held between an upper die and a lower die, and a punch is inserted into the cylindrical boss to deform the bulge into a flat flange. In this manner, the cylindrical boss having a flat flange at its inside foot is formed integrally with the base plate solely in a press work. Since the bulge is formed in a completely confined space in the die structure, no crack or defect is developed in or on the bulge as opposed to the conventional process described above.

Preferably, a third process is further performed after the flange is formed in the cylindrical boss to form a corner step at the foot of the flange which supports a bearing and to obtain a further accurate inner diameter of the cylindrical boss. A punch is inserted into the inner diameter of the cylindrical boss to squeeze some material out of the cylindrical boss while firmly holding the work between lower and upper dies. The squeezed material forms a corner step at the foot of the flange.

The cylindrical boss having accurate dimensions, a high mechanical strength and a high reliability can be manufactured in a simple process according to the present invention.

Other objects and features of the present invention will become more readily apparent from a better understanding of the preferred embodiment described below with reference to the following drawings.

DETAILED DESCRIPTION OF THE PREFERRED EMBODIMENT

Figure 1:
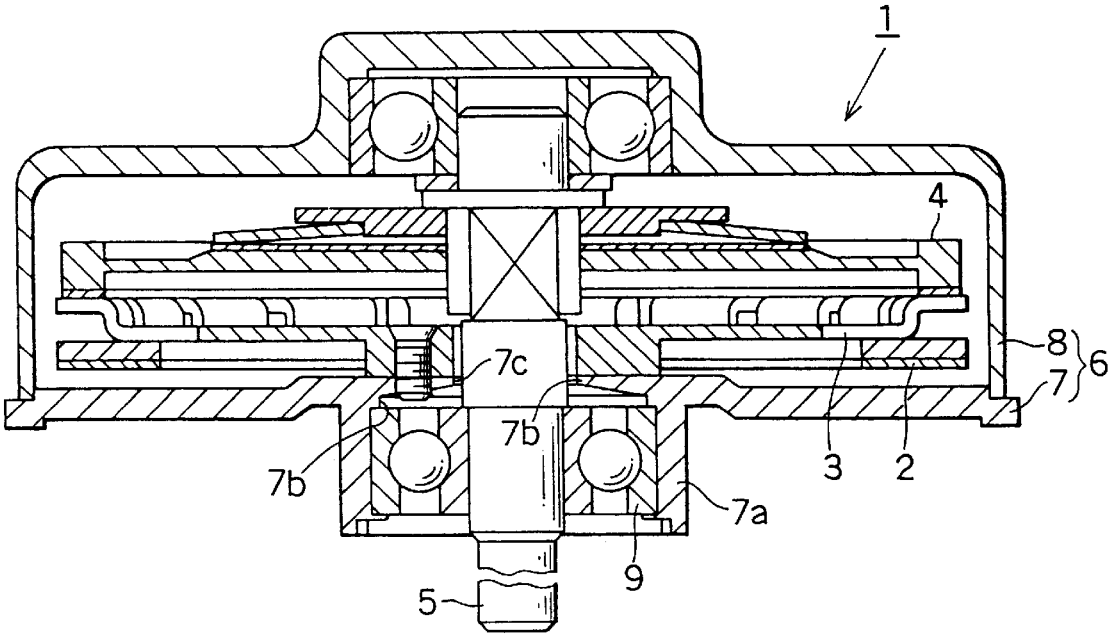
FIG. 1 is a cross-sectional view showing an ultrasonic motor in which a housing base having a cylindrical boss formed by a method according to the present invention is used.

The present invention will be described referring to FIGS. 1–7, taking a housing base used in an ultrasonic motor as an example. Referring to FIG. 1, an ultrasonic motor 1 is composed of a housing 6 having a base 7 and a cover 8, a stator 3 mounted on the base 7, a rotor 4 having a rotational shaft 5 slidably rotating on the stator 3, and other components. The rotational shaft 5 is rotatably supported in the housing 6 by two bearings. The rotational shaft 5 fixed to the rotor 4 extends through a through-hole 7*c* formed on a flange 7*b* of the base 7. A bearing 9 is held in a center boss 7*a*, an outer race of which abuts with a corner step 7*d* formed at a foot of the flange 7*b*. A piezoelectric element 2 is attached to the stator 3 on its bottom surface. When a drive voltage is supplied to the piezoelectric element 2, progressive wave is generated, and thereby the rotor 4 contacting the stator 3 rotates.

Figure 2:
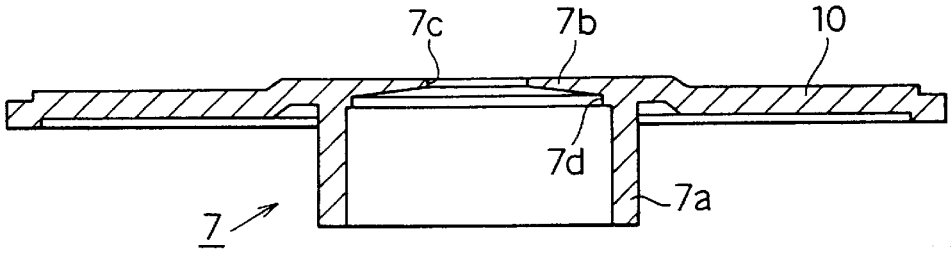
FIG. 2 is a cross-sectional view showing the housing base used in the ultrasonic motor shown in FIG. 1.

The base 7 of the housing 6 is shown in FIG. 2. The base 7 has the center boss 7*a* and the flange 7*b*, both being formed integrally with a base plate 10. The corner step 7*d* is formed at a foot of the cylindrical boss 7*a*. The through-hole 7*c* is formed at a center portion of the flange 7*b*. The base 7 is processed from a crude work made of steel plate through a bulge forming process (a first process), a flange forming process (a second process) and a corner step forming process (a third process), all of which will be described below.

Figure 3:
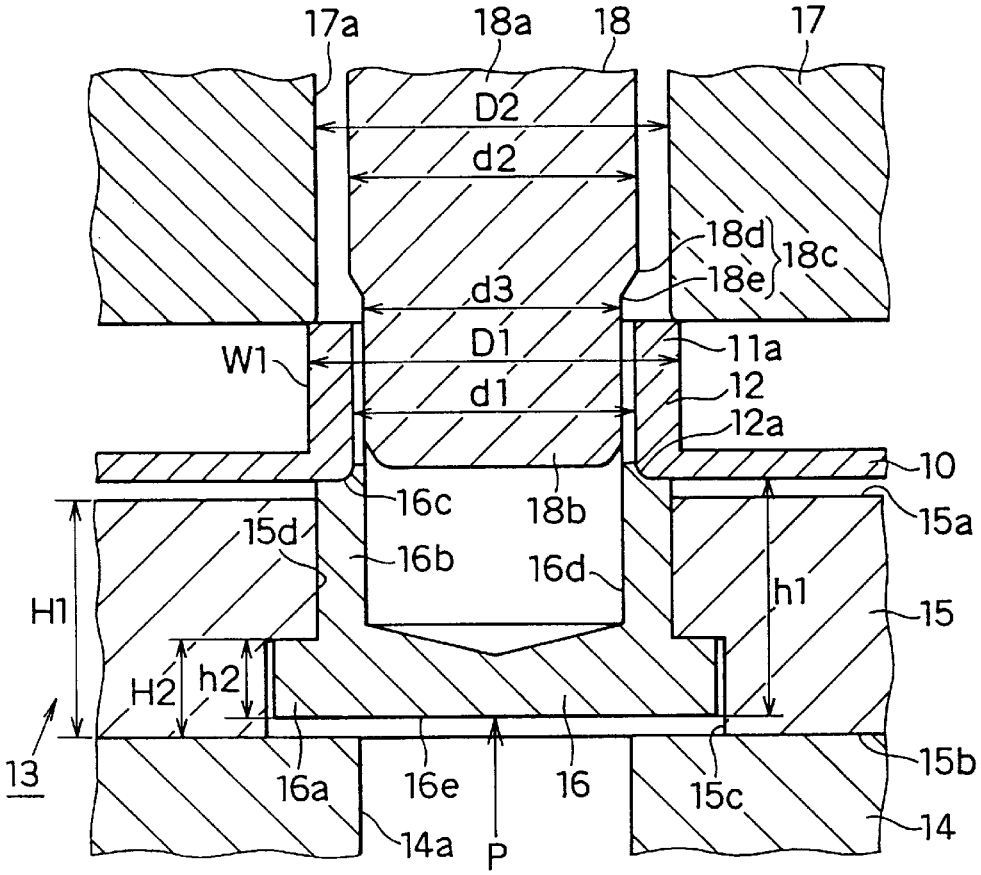
FIG. 3 is a cross-sectional view showing a die structure for making a bulge at a base portion of the cylindrical boss.
Figure 4:
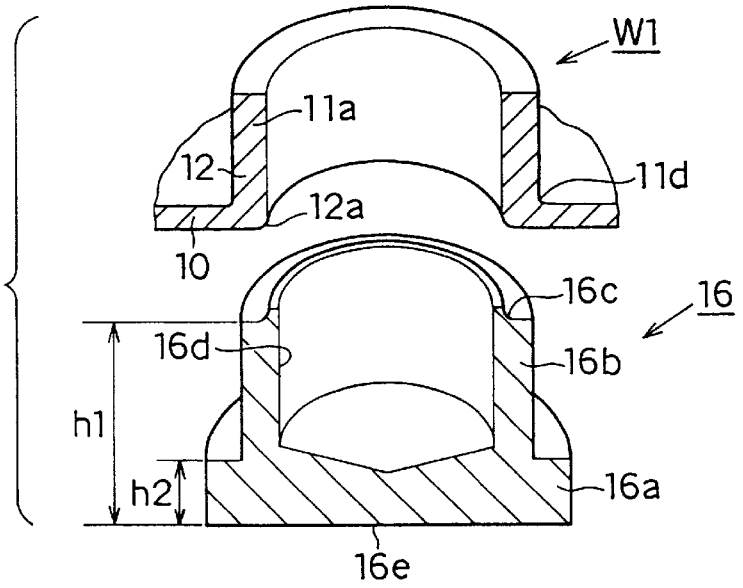
FIG. 4 is a perspective view showing a portion of a work to be processed and a portion of the die structure.

The bulge forming process (the first process) will be described first, referring to FIGS. 3, 4 and 5. FIG. 3 shows a die 13 for forming a bulge 12*b* (shown in FIG. 5) on a crude work W1. FIG. 4 shows a perspective view of the work W1 and a cushion ring 16. The crude work W1 made of a steel plate has a base plate 10 and a cylindrical portion 11*a* which is formed by a fluing process. The die 13 is composed of a holder 14, a first plate 15 placed on the holder 14, a cushion ring 16 which is slidably guided by the first plate 15, an ironing die 17, and a first punch 18. The holder 14 supports the first plate 15 thereon, and has a through-hole 14*a* through which a fluidic pressure is introduced. The first plate 15 has an upper surface 15*a* for supporting the work W1 thereon and a lower surface 15*b* contacting the holder 14. A guide bore 15*d* and an enlarged bore 15*c* are formed in the center of the first plate 15. The cushion ring 16 (shown in FIGS. 3 and 4) has a flange 16*a* and a cylindrical portion 16*b*. A rounded recess 16*c* for supporting the work W1 thereon is formed at an upper end of the cylindrical portion 16*b*. The rounded recess 16*c* is shaped so that it fits a rounded corner of the work W1. A guide bore 16*d* for guiding the first punch 18 therein is formed in the center of the cushion ring 16. An outer diameter of the cylindrical portion 16*b* is the same as a diameter of the guide bore 15*d*, so that the cushion ring 16 is slidably guided by the first plate 15. A height h2 of the flange 16*a* is smaller than a height H2 of the enlarged bore 15*c*, and an outer diameter of the flange 16*a* is little smaller than the enlarged bore 15*c*, so that the flange 16*a* is freely received in the enlarged bore 15*c*. A height hl of the cushion ring 16 (a distance form the lower surface 16*e* to a flat surface of the rounded recess 16*c*) is the same as a height H1 of the first plate 15. Therefore, as shown in FIG. 3, the rounded recess 16*c* sticks out from the upper surface 15*a* when a fluidic pressure P is applied to the lower surface 16*e* and the first punch 18 does not press down the work W1.

The work W1 is placed on the cushion ring 16, being received on the rounded recess 16*c*. The ironing die 17 is placed on the cylindrical boss 11*a* of the work W1. The first punch 18 is positioned above the cylindrical boss 11*a*, as shown in FIG. 3. A bore 17*a* having a diameter of D2 is formed in the ironing die 17. The diameter D2 is smaller than an outer diameter D1 of the cylindrical boss 11*a*. The first punch 18 is composed of a large rod 18*a* having a diameter of d2, a small rod 18*b* having a diameter of d3, and a connecting portion 18*c* which connects the large rod 18*a* and the small rod 18*b*. The connecting portion 18*c* has two corner radii 18*d* and 18*e*. The diameter d2 is larger than an inner diameter d1 of the cylindrical boss 11*a*, and the diameter d3 is smaller than the diameter d1 and the same as the diameter of the guide bore 16*d*.

Figure 5:
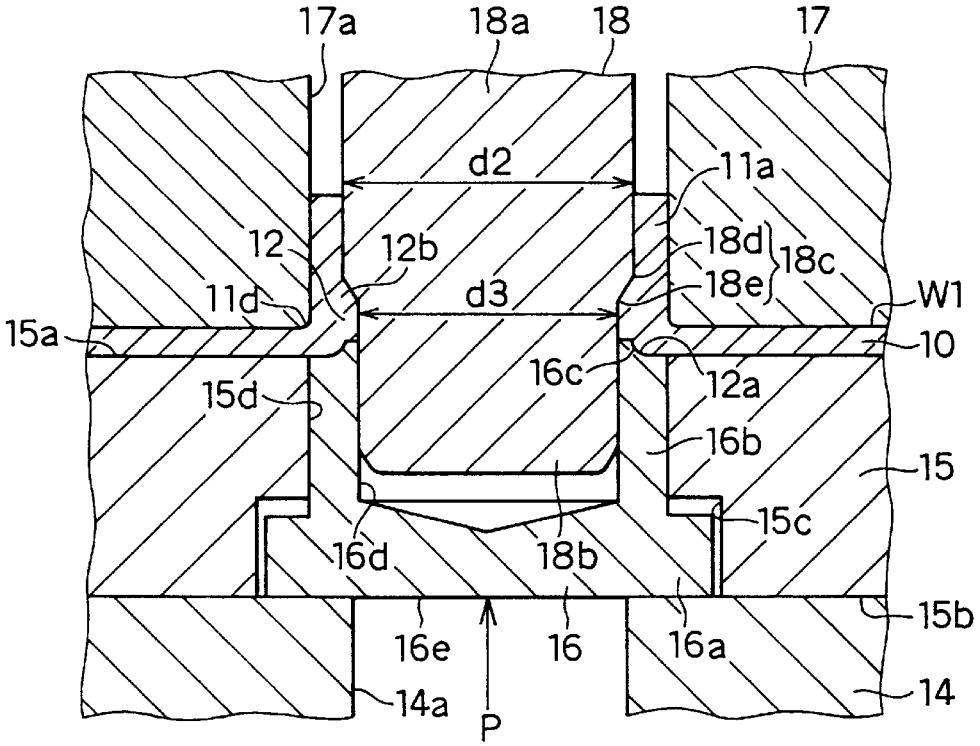
FIG. 5 is a cross-sectional view showing the die and the work on which the bulge has been formed.

The bulge 12*b* is formed at the base portion 12 of the cylindrical boss 11*a* by pressing down the first punch 18 and the ironing die 17 from the position shown in FIG. 3 to the position shown in FIG. 5. After the work W1 (a crude work at this time) is positioned in the die 13 as shown in FIG. 3, the first punch 18 and the ironing die 17 are pressed down simultaneously against the work W1, while the pressure P is applied to the cushion ring 16 from its lower surface 16*e*. The downward movement continues until the die 13 comes to the position shown in FIG. 5. During the die movement, the diameter d1 of the cylindrical boss 11*a* is enlarged by the diameter d2 of the first punch 18, and the diameter D1 of the cylindrical boss 11*a* is ironed (squeezed) by the diameter D2 of the ironing die 17. Therefore, the cylindrical boss 11*a* is deformed, and squeezed material from the cylindrical boss 11*a* forms the bulge 12*b* when the die reaches the position shown in FIG. 5. When the die 13 takes the position shown in FIG. 5, the lower surface 16*e* of the cushion ring 16 abuts against the holder 14, and the flat surface of the rounded recess 16*c* comes to the level of the upper surface 15*a* of the first plate 15, because the height H1 of the first plate 15 is equal to the length h1. Therefore, a space for forming the bulge 12*b* is completely confined by the cushion ring 16, the first punch 18 and the ironing die 17, and accordingly the bulge 12*b* does not swell beyond the confined space.

Figure 6:
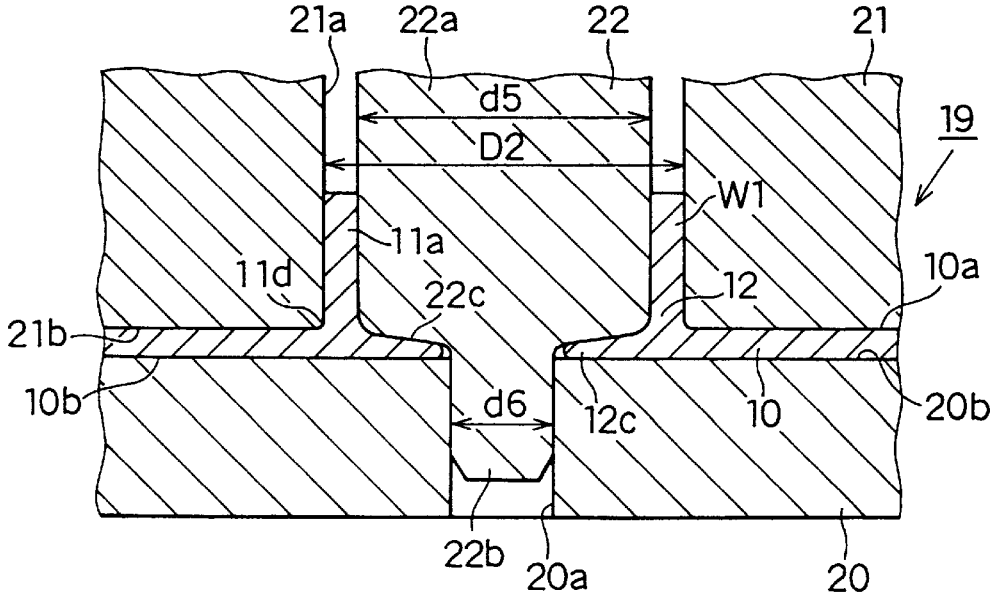
FIG. 6 is a cross-sectional view showing a work and a die for forming a flange by deforming the bulge.

After the bulge 12*b* is formed as above, the flange forming process (second process) is carried out. FIG. 6 shows a die 19 for flange forming process and the work W1 with the flange 12*c* formed in this process. The flange forming die 19 is composed of a second plate 20, a fixing die 21 and a second punch 22. The second plate 20 has an upper surface 20*b* which supports the work W1 thereon and a guide bore 20*a* for slidably guiding the second punch 22 therein. The fixing die 21 has a lower surface 21*b* for pushing down the upper surface 10*a* of the work W1 and a bore 21*a* having the diameter D2 (which is same as the outer diameter of the cylindrical boss 11*a*) for supporting the outer periphery of the cylindrical boss 11*a*. The second punch 22 is composed of a large rod 22*a* having a diameter of d5, a small rod 22*b* having a diameter of d6, and a tapered connecting portion 22*c* connecting the large rod 22*a* and the small rod 22*b*. The diameter d5 is equal to the diameter d2 of the large rod 18*a* of the first punch 18. The diameter d6 is much smaller than the diameter d3 of the small rod 18*b* of the first punch 18.

The work W1 having the bulge 12*b* is firmly held between the second plate 20 and the fixing die 21. Then, the second punch 22 is forcibly moved to the position shown in FIG. 6, thereby the bulge 12*b* is deformed into the shape of the flange 12*c* in a confined space between the upper surface 20*b* and the connecting portion 22*c*, as shown in FIG. 6.

Figure 7:
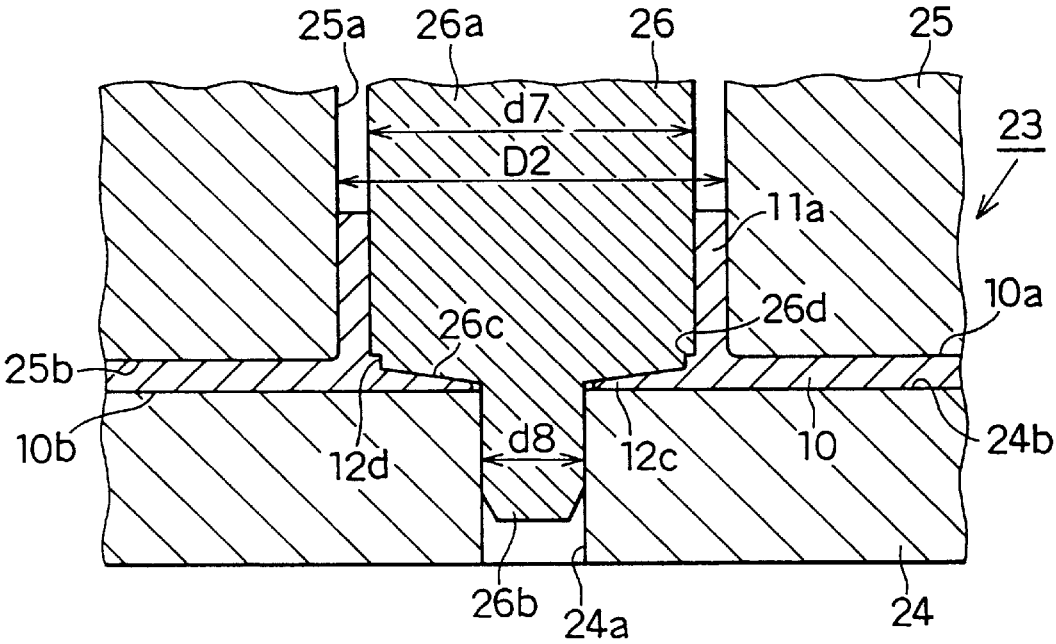
FIG. 7 is a cross-sectional view showing a work and a die for forming a recess at a foot of the cylindrical boss.
Figure 8:
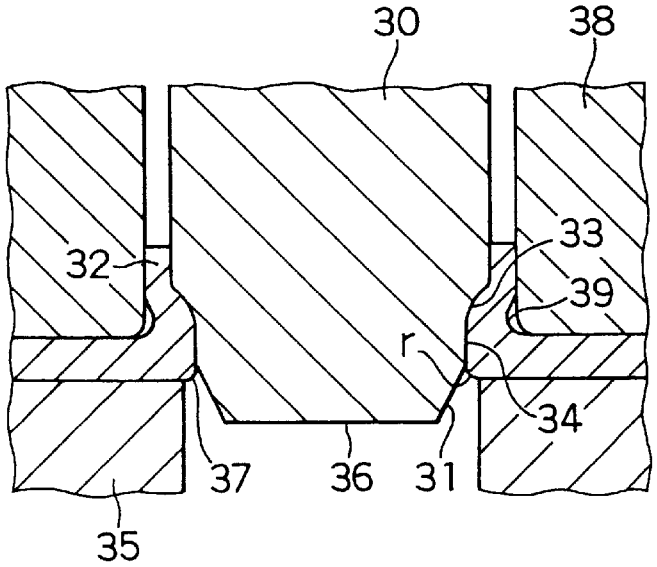
FIG. 8 PRIOR ART
FIG. 8 is a schematic cross-sectional view for explaining a conventional method of forming a bulge on a cylindrical boss.

Then, the work having the flange 12*c* is subjected to the corner step forming process (third process). A die 23 used in the corner step forming process is shown in FIG. 7. The die 23 is composed of a third plate 24, a fixing die 25 and a third punch 26. The third plate 24 has an upper surface 24*b* for supporting the work thereon and a guide bore 24*a* for guiding the third punch 26 therein. The fixing die 25 has a lower surface 25*b* for pushing down the base plate 10 of the work and a bore 25*a* having the diameter D2 which is the same as the outer diameter of the cylindrical boss 11*a*. The third punch 26 has a large rod 26*a* having a diameter d7, a small rod 26*b* having a diameter d8 and a tapered connecting portion 26*c* which connects the large rod 26*a* and the small rod 26*b*. The diameter d7 is a little larger than the diameter d5 of the second punch 22. In other words, the diameter d7 is a little larger than the inner diameter of the cylindrical boss 11*a* before performing the corner step forming process. The diameter d8 is smaller than the diameter d6 of the second punch 22. A recess 26*d* is formed at the corner of the large rod 26*a* for forming a corner step 12*d* at the foot of the cylindrical boss 11*a*.

The corner step forming process is performed in the following manner. The work having the flange 12*c* is firmly held between the third plate 24 and the fixing die 25. The third punch 26 is forcibly moved into the cylindrical boss 11*a,* thereby squeezing down some material of the cylindrical boss 11*a* and forming the corner step 12*d* at the inner foot of the cylindrical boss 11*a*. At the same time, the flange 12*c* is further pressed down into a final shape. The cylindrical boss 11*a* is shaped into a final size in this process. The final shape of the cylindrical boss 11*a* corresponds to the center boss 7*a* shown in FIG. 1, the final shape of the flange 12*c* to the flange 7*b*, and the corner step 12*d* to the corner step 7*d* which supports the outer race of the bearing 9.

Features and advantages of the method of forming a cylindrical boss according to the present invention will be summarized as follows. (1) In the bulge forming process, the first punch 18 forcibly enlarges the inner bore of the cylindrical boss 11*a,* and at the same time the ironing die 17 forcibly compresses the outer periphery of the cylindrical boss 11*a*. Therefore, material constituting the cylindrical boss 11*a* is squeezed into a confined space between the die components, and thereby the bulge 12*b* which has no defects or cracks is formed in a simple process. (2) In the bulge forming process, the cushion ring 16 is used to support the work thereon, and the cushion ring 16 is pressurized upwardly against the downward force of the upper dies. The work interposed between the cushion ring 16 and upper dies including the first punch 18 and the ironing die 17 is always pressed from both directions during the whole process. Therefore, the space for forming the bulge 12*b* is confined by the die components, which results in forming a solid bulge. (3) In the flange forming process, the work having the bulge 12*b* is firmly held between the second plate 20 and the fixing die 21 during the downward movement of the second punch 22. Therefore, the bulge 12*b* is easily deformed into the shape of the tapered flange 12*c*. (4) In the corner step forming process, the third punch 26 having a diameter which is a little larger than the inner bore of the cylindrical boss 11*a* is used, while the outer periphery of the cylindrical boss 11*a* is firmly held in the bore of the fixing die 25. Therefore, the inner diameter of the cylindrical boss 11*a* is ironed into a final dimension so that no additional machining is necessary. At the same time, the corner step 12*d* which serves as a support of a bearing is formed from material squeezed from the inner bore of the cylindrical boss 11*a*. Because the corner step 12*d* is formed integrally with the cylindrical boss 11*a,* there is no need to use an additional part for supporting a bearing.

A product having a cylindrical boss processed in the method described above is intended to be used as a housing base for an ultrasonic motor. However, the product manufactured according to the present invention can be used in various ways. For example, it may be used as a housing for various kinds of DC or AC motors, or as a part which requires a cylindrical boss and/or a flange.

The present invention may be modified in various ways. For example, only the first process of forming the bulge may be utilized without performing the other two processes. Alternatively, either one of the second and third processes may be performed after the first process. Though the flange 16*a* of the cushion ring 16 is disc-shaped in the foregoing embodiment, it may be formed in other shapes. The taper angle of the flange 12*c* may be variously changed according to needs of applications. The recess 26*d* of the third punch 26 may be eliminated, and the corner step 12*d* may be formed by adjusting a downward stroke of the third punch 26.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A method of forming a cylindrical boss, the method comprising steps of:

positioning a work having a crude cylindrical boss formed on and integrally with a base plate in a first die, the first die having a first plate, a cushion ring slidably supported in the first plate, a first punch slidably movable into the cushion ring and an ironing die disposed outside of the first punch, so that the work is supported on the cushion ring;

enlarging an inner diameter of the crude cylindrical boss by forcibly inserting the first punch into the crude cylindrical boss;

ironing an outer diameter of the crude cylindrical boss, simultaneously with the enlarging step, by forcibly sliding the ironing die along the outer diameter of the crude cylindrical boss;

applying a pressure, during the enlarging and ironing steps, to the work in a direction against a force applied to the work by enlarging and ironing the crude cylindrical boss; and thereby forming the cylindrical boss having a bulge at an inside foot thereof, the bulge being formed with material deformed from the crude cylindrical boss.

2. The method of forming a cylindrical boss as in claim 1, wherein the method further comprising steps of:

positioning the work having the cylindrical boss with the bulge formed at the foot thereof in a second die, the second die having a second plate, a second punch slidably movable into the second plate and a fixing die disposed outside of the second plate, so that the work is firmly held between the second plate and the fixing die; and pressing the second punch against the bulge, so that the bulge deforms into a flange having a flat shape between the second punch and the second plate, the flange extending inwardly from the inside foot of the cylindrical boss.

3. The method of forming a cylindrical boss as in claim 2, the method further comprising steps of:

positioning the work having the cylindrical boss with the flange in a third die, the third die having a third plate, a third punch slidably movable into the third plate, the third punch having a recess at a position corresponding to a foot of the flange, and a fixing die disposed at outside of the third punch, so that the work is firmly held between the third plate and the fixing die;

enlarging an inner diameter of the cylindrical boss by forcibly inserting the third punch into the cylindrical boss, thereby making the inner diameter of the cylindrical boss a final dimension; and forming a corner step at the foot of the flange from material squeezed from the cylindrical boss in the enlarging step.

4. A die for forming a cylindrical boss formed on and integrally with a base plate, the die comprising:

a first plate for supporting the base plate thereon;

a cushion ring for supporting and pushing up an inside foot portion of the cylindrical boss, the cushion ring being slidably supported in the first plate;

an ironing die having a bore, a diameter of which is smaller than an outside diameter of the cylindrical boss, the ironing die being slidably supported above the cushion ring so that the ironing die is movable downwardly along the outside diameter of the cylindrical boss; and a first punch having a diameter which is larger than an inside diameter of the cylindrical boss, the first punch being slidably supported above the cushion ring so that the first punch is movable downwardly along the inside diameter of the cylindrical boss together with the ironing die.

* * * * *